United States Patent [19]

Rath

[11] 3,991,474

[45] Nov. 16, 1976

[54] MEASUREMENT TOOL

[76] Inventor: Lonnie Milo Rath, Baker, Mont. 59313

[22] Filed: June 12, 1975

[21] Appl. No.: 586,183

[52] U.S. Cl. ..... 33/98; 33/27 C

[51] Int. Cl.[2] ..... B43L 7/06

[58] Field of Search ..... 33/27 C, 93, 97, 98, 33/99, 75, 161

[56] References Cited

UNITED STATES PATENTS

| | | | |
|---|---|---|---|
| 378,257 | 2/1888 | Leschorn | 33/93 |
| 1,332,887 | 3/1920 | Collins | 33/27 C |
| 1,366,800 | 1/1921 | Hayden | 33/27 C |
| 1,601,138 | 9/1926 | Moore | 33/98 |
| 1,622,158 | 3/1927 | Liberty | 33/98 |
| 1,916,638 | 7/1933 | Rizianu | 33/98 |
| 2,042,213 | 5/1936 | Ducey | 33/98 |
| 2,686,973 | 8/1954 | Christianson et al. | 33/98 |
| 3,751,813 | 8/1973 | Kuwada | 33/27 C |

*Primary Examiner*—Richard E. Aegerter
*Assistant Examiner*—John W. Shepperd
*Attorney, Agent, or Firm*—Robert E. Kleve

[57] ABSTRACT

The invention comprises a measurement tool. The measurement tool has a pair of elongated main measurement sticks which are slidably mounted to move longitudinally toward and away from one another. The main measurement sticks have indicia thereon to identify the length of the two main measurement sticks. A pair of lateral stick members are pivotally mounted centrally of their length to the outer ends of the main sticks. The laterally stick members have half circle center portions with markings thereon to identify the angular position of the laterally stick members. A measurement stick is slidably mounted to telescope longitudinally inward and outward in one lateral stick member. The slidable stick has a hole at its outer end to receive the point of a pencil whereby the pencil point may be inserted into the hole and the slidable stick and the one lateral stick member may be pivoted about the pivotal axis of the lateral stick and the pencil will draw a circle about said axis or surface beneath the tool depending upon the adjustment of the sliding stick to the one lateral stick member.

1 Claim, 8 Drawing Figures

MEASUREMENT TOOL

This invention relates to carpenter rules and measurement tools, more particularly, it relates to adjustable measurement tools.

It is an object of the invention to provide a novel adjustable measurement tool which has adjustable main frame members to adjust to different lengths, pivotally mounted lateral measurement stick members adjustable to different angles, and a slidable stick within one of said lateral stick members having a hole at its outer end, whereby a pencil may be inserted into the hole and the slidable stick and lateral stick members may be pivoted to draw circles of different sizes.

It is another object of the invention to provide a novel adjustable measurement tool which can measure different lengths and different angles and which can also be used to draw circles of different sizes.

Further objects and advantages of the invention will become apparent as the description proceeds and when taken in conjunction with the accompanying drawing wherein.

Figures 1, 2, 3, 4, 5, 6, 7, 8:
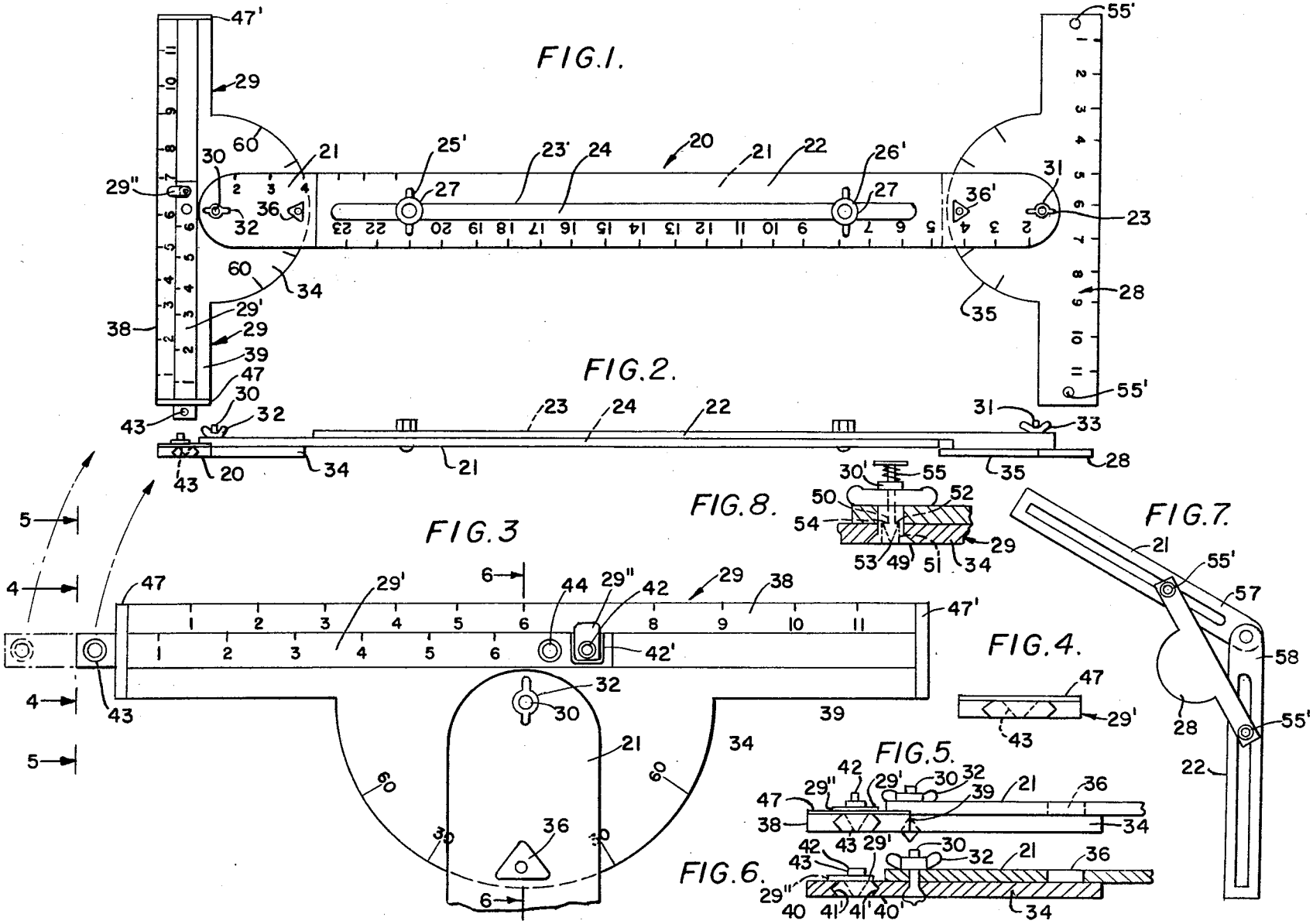
FIG. 1 is a top plan view of the adjustable measurement tool for measuring different lengths and different angles and drawing circles of different sizes.
FIG. 2 is an end view of the measurement tool.
FIG. 3 is a top view of the lateral stick carrying the slidable stick.
FIG. 4 is an end view taken along line 4—4 of FIG. 1.
FIG. 5 is an end view taken along line 4—4 of FIG. 4, illustrating the entire lateral stick portion and its slidable stick and its attachment to one of the main panels or sections.
FIG. 6 is a cross-sectional view taken along line 6—6 of FIG. 3.
FIG. 7 is a top view of the two sliding panels and one of the lateral stick being used as a brace to the sliding panels for using the apparatus for drawing large size angles.
FIG. 8 is a fragmentary view of the modified bolt attachment with the sliding pin.

Briefly stated, the invention comprises a measurement tool having a pair of elongated main panels which overlapp one another in adjustable relationship for measurement of different lengths, a pair of lateral measurement sticks pivotably mounted to the outer ends of the main panels having a semicircular portions at their centers to indicate the angle of pivotal movement of the lateral stick in relation to the main stick for drawing lines at different angles, a slidable stick slidable longitudinally within one of said lateral sticks, said slidable sticks having a hole at its outer end, so that the slidable stick may be adjusted inward or outward in the lateral stick to adjust the holes inward and outward away to different positions from the pivotal mounting of the lateral stick carrying the slidable stick, so that a pencil may be inserted into the hole and the sliding stick and the lateral stick carrying the sliding stick may be pivoted about the pivotally mounting of the lateral stick with the pencil projecting through the hole to draw a circle of a selected diameter.

Referring more particularly to the drawings in FIG. 1 the measurement tool invention 20 is illustrated as having one elongated slidable panel 21 and another elongated slidable panel 22. The slidable panels 21 and 22 have each a slot 23 and 24, respectively. The panel 22 overlaps panel 21 within a pair of bolts 25 and 26 projecting through slots 23 and 24 with the heads of the bolts being longer than the slots and abutting the underside of panel 21. Wing nuts 25' and 26' are threaded onto the tops of bolts 25 and 26, respectively. The wing nuts 25' and 26' have enlarged collar portions 27 which are larger than the slots, so that when the wing nuts 25' and 26' are threaded down against the top of panel 22, they will lock the sliding panels in their adjusted position.

The panels 21 and 22 have each indicia along their longitudinal edges so that the panels may be slid toward and away from one another to an adjusted revised length while the wing nuts 25' and 26' are loosened, and then the wing nuts may be tightened to lock the panels in their adjusted position.

A pair of lateral measurement sticks 28 and 29 are pivotally mounted to the outer ends of measurement panels 21 and 22, respectively, by bolts 30 and 31 and nuts 32 and 33. The measurement sticks 28 and 29 have each half moon portions or semicircular portions 34 and 35 fixed centrally on lateral sticks 28 and 29, respectively. The semicircular portions have angular degree markings therein and the measurement sticks 28 and 29 have a hole 36 and 37 therein in arcuate alignment with the degree markings on the semicircular portions, so that the measurement sticks 28 and 29 may be pivoted about bolts 30 and 31 to a desired angle. The degree markings may be viewed through the holes 36 and 37 to determine the angle of the stick 28 and 29 relative to the panels 21 and 22.

The one measurement stick 29 has two stick portions 38 and 39 in spaced parallel relation forming a slot therebetween. A short ruler or stick 29' is slidably mounted in the stick portions 38 and 39. The stick portions 38 and 39 have concave V-shaped recesses 40 and 40' along their side edges forming the slot. The short stick 29' has V-shaped convex outside edges 41 and 41' to slidably engage the concave recesses 40 and 40' in the sticks 38 and 39 in complimentary relation forming a slotted guideway for the stick 29'. A screw 42 extends through a plate 29'' and is threaded into stick 29'. The stick 29' has a recess 42' so that the screw 42 may be tightened down against the plate 29'' to lock the stick 29' to section 38' in its adjusted position by the plate 29'' engaging stick 29' and section 38'.

When it is desired to draw a circle upon a surface, the tool will be laid longitudinally or flush upon the surface. The screw 42 may be loosened. The stick 29' has a pair of holes 43 and 44 at its outer end. The short stick 29' may be slid outward or inward in the guideway relative to sections 38 and 39 so that the hole 43 is a desired distance from the center bolt 30, which distance is measured by means of the indicia on the stick section 38 and the slidable stick 29', so that the desired radius of the circle to be drawn may be obtained. Then the screw 42 is tightened to lock the stick 29' into adjusted position. The point of a pencil may be inserted into the hole 43, for example, to engage the surface underneath the stick 29'. The pencil may be swung horizontal with the pencil point inserted in the hole 43 to pivot the stick 29' and sections 38 and 39 about bolt 30 so that a circle may be drawn on the surface underneath the stick 29' by the point of the pencil projecting through the hole 43 of the desired radius, depending upon the adjustment of the measurement stick 29' to the sections 38 and 39.

Although the slide stick 29' shows a pair of holes 43 and 44 so that each hole 43 may be positioned to a desired radius such as illustrated in phantom lines, only a single hole 43 is necessary since the stick 29' can slide completely through the measurement stick 29 from one end 45 to the other end 46 while riding in the V-shaped recesses.

A pair of metal straps 47 and 47' are fixed to the stick portion 38 and 39 to the outer end to hold the stick portions 38 and 39 in the spaced parallel relation, as illustrated, the metal straps 47 and 47' are slightly spaced above the slidable stick 29' in their central portion so that the slidable stick 29' may slide freely along the stick portion 38 and 39 sliding freely underneath the metal straps 47 and 47'.

The bolt 30 may be made solid as shown in FIGS. 5 and 6. The bolt 30 may also be made as shown in FIG. 8 as designated by numeral 30'. The bolt 30 has an enlarged head 49 which is counter sunk into bore in the center of the bottom of the measurement stick 29. The bolt 30' has a nut 32'' which is threaded on the top of the outside of the bolt 30. The bolt 30' has a hollow center bore 50 with an enlarged lower cylindrical bore portion 51 and shoulder portion 52. A pin 53 is slidably mounted in the bore 50 to slide vertically. The pin 53 has pointed lower end and enlarged shoulder portion 54. The pin may slide upward until the shoulder portion 54 engages lower edge 52 of the bore 50 to stop the upward movement of the pin when the pin is slid upward to engage the lower shoulder of the bolt. The pin is completely recessed within the bolt so that the pointed end of the pin does not project below to the bolt. A spring 55 is mounted to the top of the pin with the lower end of the spring engaging against the top of the bolt and the upper end of the spring engaging against the enlarged head of the pin to urge the pin to its upward recessed position.

The pin may be pushed down by hand to cause the point of the pin to penetrate a wooden surface beneath the tool when the tool is being used to draw circles or angular measurements on a wooden surface by being laid on the wooden surface.

The frictional engagement between the pin and the wooden surface when the pin is penetrated will normally hold the pin in its penetrated position overcoming the force of the spring so that the pivoting stick 29 and 29' may be pivoted to draw circles by a pencil in the bore 43 of the stick 29' and the pin will keep pivoting stick 29 at a fixed center axis relative to the surface underneath by the pin acting as a fixed center axis by its projecting into the wood.

The measurement tool may also be used for measurement of steps and various other carpentry measurement tasks.

The elongated panels 21 and 22 may be bolted together at their outer ends 57 and 58, as illustrated in FIG. 7, and the measurement stick 30 has a pair of holes 55 and 55' and the measurement stick may be bolted to the panels 21 and 22 by bolts through the holes 55 and 55' through the slots 23 and 24, respectively, as illustrated to serve as a brace to keep the panels 21 and 22 at a selected angle to one another so that the panels 21 and 22 may serve as a larger rule for drawing angles of different degrees.

It will be obvious that various changes and departures may be made to the invention without departing from the spirit and scope thereof and accordingly it is not intended that the invention be limited to that specifically described in the specification or as illustrated in the day but only as set forth in the appended claims wherein:

What is claimed is:

1. A measurement tool comprising a first pair of elongated measurement sticks connected together in adjustable telescoping relation to slide longitudinally toward and away from one another; a pair of secondary laterally elongated stick means; means pivotally mounting each of said lateral stick means centrally of their length to one of the respective outer remote ends of the first pair of elongated sticks; said laterally elongated stick means being shorter in length than said first pair of elongated sticks, said lateral stick means having half moon center portions with angular markings thereon to identify the angle of each lateral stick means relative to the respective first elongated stick; one of said laterally elongated stick means comprising a pair of elongated spaced parallel members; lateral straps fixing the parallel members together in spaced parallel relation at their outer ends; a slidable marking stick being slidable in between said parallel stick member; with said parallel stick member having grooves to receive said marking stick; locking means on said marking stick; said slidable marking stick having a hole adjacent its outer end to receive a pencil point, said slidable stick and said parallel stick members of said one laterally elongated stick means having measurement marking to measure the distance from the hole at the outer end of the slidable section to the center of the parallel sticks whereby the slidable stick may be telescoped relative to the parallel stick to project the outer end of the slidable stick with the hole therein, to place the hole on the slidable stick at a selected position, and the locking means may be activated to lock the slidable stick at its selected distance; said means pivotally mounting said one laterally elongated stick comprising a sleeve pivotally mounting said one lateral stick to its respective first elongated measurement stick; a pin slidably mounted in said sleeve to be depressable to project through said one lateral stick and said respective first elongated measurement stick into the surfaces beneath the tool to keep the tool at a fixed center axis position on the surface; means limiting the downward and upward movement of the pin, whereby the pin may be depressed to project into the surface beneath the tool and a pencil point may be inserted into the hole of the slidable stick, with the slidable stick in the adjusted locked position and the slidable stick and the parallel stick members of said one lateral stick means may be pivoted about said pivotal mounting to said respective first measurement stick at said fixed center axis position on the surface, so that the pencil may draw a circle upon surfaces beneath the slidable stick with the circle having a radius depending upon the adjustment of the one slidable stick relative to the parallel stick members of the one laterally elongated stick means within the pin projecting into the surface beneath the tool to keep the tool at a fixed center axis position while drawing the circle on the surface about the center point.

* * * * *